United States Patent [19]

Pratt

[11] 4,020,606

[45] May 3, 1977

[54] STREET LIGHTING COLUMNS

[76] Inventor: John William Pratt, Goosedale Farm, Bestwood Park, Nottingham, England

[22] Filed: Oct. 29, 1975

[21] Appl. No.: 626,635

[52] U.S. Cl. ..... 52/116; 52/115; 248/159

[51] Int. Cl.[2] ..... E04H 12/34

[58] Field of Search ..... 52/115, 116, 28, 120, 52/645; 248/159

[56] References Cited

UNITED STATES PATENTS

| | | | |
|---|---|---|---|
| 1,359,845 | 11/1920 | Schmidt | 52/116 |
| 1,438,166 | 12/1922 | Bolander | 52/116 |
| 2,975,993 | 3/1961 | Beagan, Jr. | 52/115 |
| 3,355,847 | 12/1967 | Pratt | 52/116 |
| 3,363,866 | 1/1968 | Wertmann | 52/116 |
| 3,680,448 | 8/1972 | Ballingame | 52/116 |
| 3,792,554 | 2/1974 | Archer et al. | 52/115 |

*Primary Examiner*—Ernest R. Purser
*Assistant Examiner*—Robert C. Farber
*Attorney, Agent, or Firm*—Larson, Taylor & Hinds

[57] ABSTRACT

A street lighting column has upper and lower sections hinged together in such manner that the upper section can be lifted by a double-acting piston and cylinder unit connected between the column sections to a position in which it is free to pivot relative to the base section. The hinge is provided with a support plate adapted to be turned to a position in which it cooperates with a lug on one of the column sections so as to support the upper column section in its raised pivotal position when the direction of action of the piston and cylinder unit is reversed, thus automatically effecting pivoting of the upper section to a position in which it is reachable from the ground.

8 Claims, 3 Drawing Figures

STREET LIGHTING COLUMNS

Figure 1:
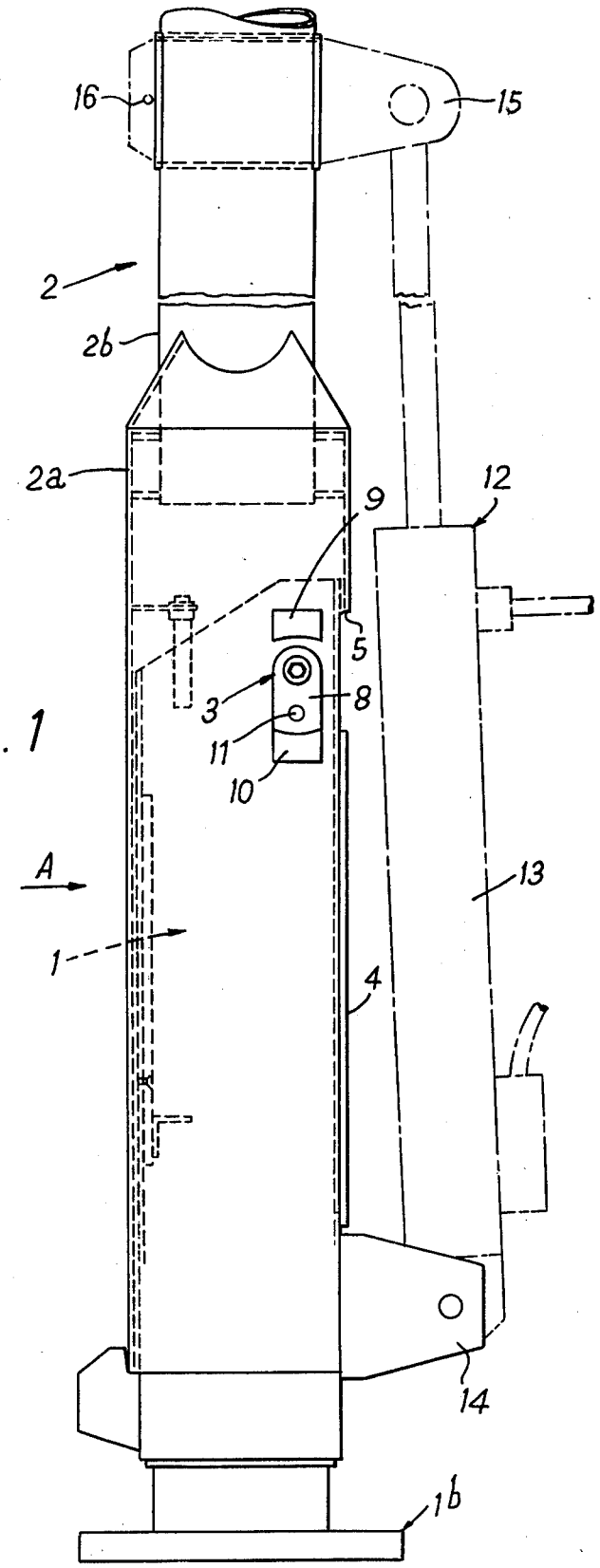

This invention relates to a street lighting column which comprises a base section and an upper section hinged to the latter and carrying a lighting unit, a raising and lowering mechanism being provided to move the upper column section from a normal upright position about the hinge so that the lighting unit can be brought to within reach of the ground (e.g. for maintenence purposes). Such a street lighting column is hereafter termed of the kind herein referred to.

According to the invention there is provided a street lighting column of the kind herein referred to in which the column sections are hinged together in such manner that the upper section can be lifted by a double-acting piston and cylinder unit connected between the column sections, to a position in which it is free to pivot relative to the base section, and in which the hinge is provided, at least at one side of the column, with a support plate adapted to be turned to a position in which it co-operates with a lug on a relevant one of the column sections to support the upper column section in its raised position when the direction of action of the piston and cylinder unit is reversed to lower the upper column section.

As will be appreciated the operation of lowering the upper column section is performed in three stages. First that section is lifted to its hinging position by extending the piston and cylinder unit. The support plate is then turned to co-operate with the said lug so that the upper column section is in effect supported by the plate and lug. Finally the piston and cylinder unit is retracted and as the upper column section is unable to settle back on to the base unit because of the lug and support plate, it pivots about the hinge under the control of the piston and cylinder unit. The upper section is returned to its upright position on the base section in the reverse fashion.

To allow the upper column to be lifted off the base section, the hinge between the two sections is capable of vertical sliding movement. Thus the hinge will normally comprise a hinge shaft carried by one of the sections and passing through vertical slots in the other section. The support plate will accordingly be carried by the column section on which the hinge is mounted.

Where a hinge shaft is employed, it is preferably turnably mounted in the relevant column section, the support plate being fixed to the shaft externally of the column. In fact, to ensure that the upper column section is supported in a balanced condition, a support plate is preferably provided at each end of the hinge shaft.

In a preferred embodiment the base section carries a hinge shaft which projects through vertical slots in the lower end of the upper column section. A support plate is provided on each end of the hinge shaft for co-operation when the upper column section has been lifted, with lugs welded on the upper section above the slots therein. In the elevated position of the upper section the support plates are turned upwardly to engage below the lugs, whereby the upper section is supported on said plates by way of the latter.

A second lug may be provided adjacent the or each support plate at a position opposite to the above-mentioned lug for co-operation with the support plate when in its normal position with the upper column section upright. This second lug will then define the position of the upper section when it is being supported by the base section.

To prevent the upper column section being accidentally lifted, a safety locking bolt may be provided to secure the or each support plate to the column in the position in which it cooperates with the said second lug. It will be appreciated that, in this embodiment, it will not be possible to lift the upper column section until the locking bolt has been released and the support plate turned to clear the said second lug.

The raising and lowering mechanism associated with the column is known as a "counterbalance unit" which term will hereinafter be used.

Normally, a single counterbalance unit will be used to service a large number of columns, being moved from column to column as required. In this event, provision will be made to enable the unit to be removably fitted to different columns. Thus, the arrangement will be such that one end of the cylinder and ram unit is fitted to the base section of the column whilst the other end is fitted to the upper section. Normally, the lower end of the cylinder will be fitted to the base section and the outer end of the ram to the upper section. One specific way of removably fitting the counterbalance unit will be described later.

Controlled lowering of the upper sectiion of the column is preferably effected by providing a throttle valve in the hydraulic fluid outlet from the cylinder of the cylinder and ram unit so that fluid flows from the unit at constant speed. In this event, the equipment will "fail safe" if a fault develops in the hydraulic system, e.g. if any of the hydraulic hoses is damaged.

Figure 2:
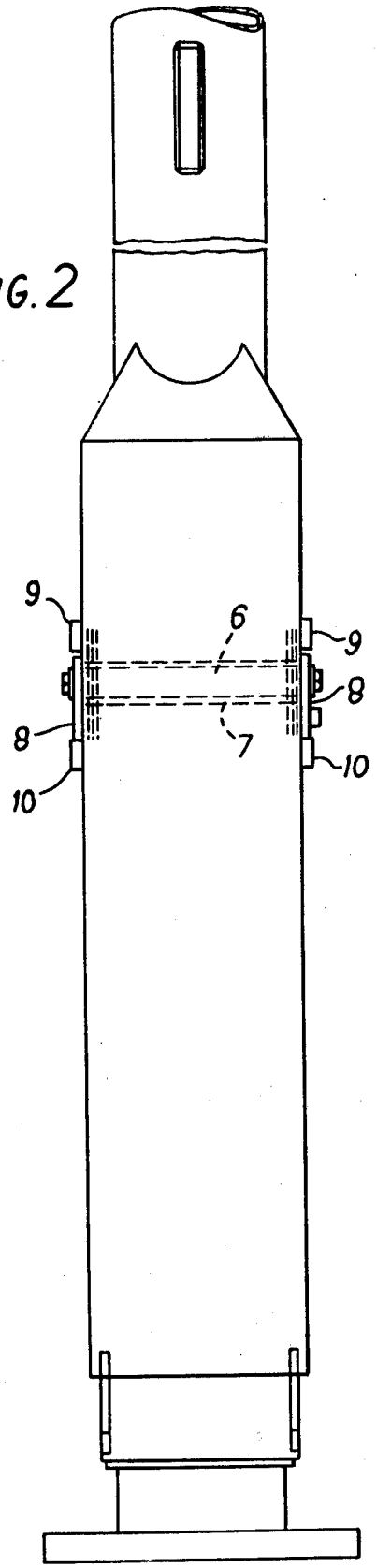
Figure 3:
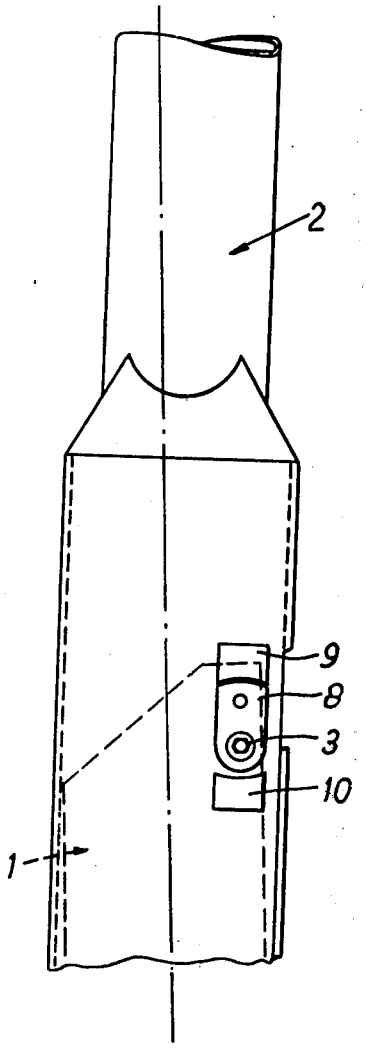

The invention will now be described further by way of example with reference to the accompaying drawings in which:

FIG. 1 is a side view of a street lighting column according to one embodiment of the invention, FIG. 2 is a view in the direction of arrow A in FIG. 1, FIG. 3 is a detail view corresponding to part of FIG. 1 showing the column at the beginning of the lowering operation.

The column shown in the drawings comprises a base section 1 which has an apertured base plate **1*b* embedded in the ground, and an upper section 2 which is pivoted to the base section at 3 and is normally supported by the base section as shown in FIGS. 1 and 2. Base section 1 is hollow and of rectangular cross section, the upper end being tapered rearwardly (to the left as viewed) as can be seen in FIGS. 1 and 3. The section is fitted at its front side with a removable inspection door 4** which permits access to the lighting gear (not shown).

The upper section 2 consists of a rectangular-section lower portion **2*a* and a circular-section pole 2*b* which projects upwardly from portion 2*a* and carries the lighting unit (not shown) of the column. The front wall of the lower portion 2*a* is shorter than the side and rear walls, terminating at a position 5** just below the top of the corresponding part of the base section.

The hinge between the two column sections comprises a shaft 6 received in a tube 7 and fitted in aligned apertures in the side walls of the base section 1 of the column. The shaft extends through vertical slots (not visible) in the side walls of portion **2*a*** of the upper column section to allow vertical movement of the upper column section to an extent limited by the length of the slots.

Fitted to each end of shaft 6 is a support plate 8 positioned to co-operate with a pair of lugs 9, 10 disposed respectively above and below the plate on the upper column section. Shaft 6 is turnable in the base section to allow the support plates to turn together. A locking bolt 11 normally secures one of the support plates 8 in a downwardly-directed position when the column sections are in their normal position of use, as shown in FIGS. 1 and 2, with the upper end of the base section 1 disposed just inside the short front wall of the lower portion 2*a* of the upper column section. It will be appreciated that, in this position, a support plate and co-operating lug 10 positively prevent lifting of the upper column section.

Movement of the upper section 2 between its normal vertical position and its lowered position is effected by means of a detachable counterbalance unit shown in chain dotted lines at 12. This unit comprises a main double-acting hydraulic cylinder and ram unit 13 the cylinder of which is removably mounted at its lower end to a pair of lugs 14 welded to the base section 1 of the column. The upper end of the ram of unit 12 is pivoted to a plate 15 fitted through a slot in the pole 2*b* of the upper column section 2. This slot is formed by a pair of diametrally-aligned apertures in pole 2*b* and a pair of spaced reinforcing plates welded inside the pole. Plate 15 is apertured at 16 at its outer end to receive a locking pin (not shown) inserted through aligned apertures in the lugs and in the bottom of the cylinder.

Lowering of the upper column section is effected as follows:

The locking pin 11 is first removed and the two support plates 8 turned to clear the bottom lug 10. The ram of the piston and cylinder unit is then extended to lift the upper column section to a position in which its short front wall is clear of the top of the base section. The support plates 8 can then be turned to the position shown in FIG. 3 in which they co-operate with the upper lugs 9. In this position the upper column section can be supported entirely by the lugs and support plates.

Retraction of the ram of the piston cylinder unit then draws the upper column section downwardly about the hinge, the speed of descent being controlled by a throttle valve (not shown) through which fluid flows from the cylinder of the unit at a controlled rate. It will be appreciated that this valve ensures that the column section will be lowered safely even in the event of damage to the hydraulic hoses. The column is returned to its position of use after servicing of the lighting unit by again extending the ram of the piston cylinder unit to a position in which the support plates 8 can be turned back to their original positions, and then again retracting the ram to allow the upper column section to settle back on to the base section.

What is claimed is:

1. A street lighting column comprising a base section, an upper section normally supported upright by said base section but movable vertically between its normal supported position and a raised position in which it is free to pivot relative to said base section, a hinge connection between said sections permitting said vertical and pivotal movements, a raising and lowering mechanism for effecting said vertical and pivotal movements so as to move said upper section from a normal upright position to a lower pivoted position within reach from the ground, said raising and lowering mechanism comprising a fluid powered double-acting piston and cylinder unit connected between the common sections and which is operable in a first direction to lift said upper section vertically to said raised position in which it is free to pivot relative to the base section, said hinge including a support plate which is turnable between a normal position in which it permits the upper column section to stand in its normal upright non-pivotable position and a position in which it cooperates with a lug on one of said column sections to support the upper section in its raised pivotable position, the piston and cylinder unit being operable in its other direction to automatically pivot said upper section, supported by said support plate in its raised pivotable position, about said hinge and thus lower said upper section to within reach from the ground, whereby, starting from the normal upright position of said upper section and with said support plate in its said normal position, said piston and cylinder unit can be powered in its first direction to raise said upper section vertically to its raised pivotable position, said support plate can then be turned to cooperate with said lug to support said upper section in its raised pivotable position, said piston and cylinder unit can then be reversed to its other direction to pivot said upper section automatically about said hinge, then said piston and cylinder unit can be powered again in its first direction to pivot said upper section reversely to its upright position, said support plate can be turned to its normal position, and said upper section can be vertically lowered by said piston and cylinder unit to its normal upright supported position.

2. A street lighting column as claimed in claim 1 in which the hinge comprises a hinge shaft carried by one of the sections and passing through slots in the other section, the length of the slots limiting the amount by which the upper section can be lifted with respect to the base section.

3. A street lighting column as claimed in claim 2 in which the hinge shaft is turnably mounted in the relevant column section, the support plate being fixed to the shaft externally of the column.

4. A street lighting column as claimed in claim 3, in which a support plate is provided at each end of the hinge shaft.

5. A street lighting column as claimed in claim 1 in which the base section carries a hinge shaft which projects through vertical slots in the lower end of the upper column section, a support plate being provided on each end of the hinge shaft for co-operation when the upper column has been lifted, lugs being welded on the upper section above the slots therein so that in the elevated position of the upper section the support plates can be turned upwardly to engage below the lugs, whereby the upper section is supported on the plates by way of the latter.

6. A street lighting column as claimed in claim 5, in which a second lug is provided adjacent the or each support plate at a position opposite to the above-mentioned lug for co-operation with the support plate when in its normal position with the upper column upright, the second lug defining the position of the upper section when it is being supported by the base section.

7. A street lighting column as claimed in claim 6, in which a safety locking bolt is provided to secure the or each support plate to the column in the position in which it co-operates with the second lug to prevent the upper column being accidentally lifted.

8. A street lighting column as claimed in claim 1 in which the double acting piston and cylinder unit is hydraulically operable, a throttle control valve being provided in the hydraulic fluid outlet from the cylinder to enable controlled raising and lowering of the upper column section.

* * * * *